US010779670B1

(12) United States Patent
Day

(10) Patent No.: US 10,779,670 B1
(45) Date of Patent: Sep. 22, 2020

(54) REUSABLE URINAL MAT WITH REPLACEABLE ABSORBENT PAD

(71) Applicant: Mark Day, Houston, TX (US)

(72) Inventor: Mark Day, Houston, TX (US)

( * ) Notice: Subject to any disclaimer, the term of this patent is extended or adjusted under 35 U.S.C. 154(b) by 0 days.

(21) Appl. No.: 16/554,321

(22) Filed: Aug. 28, 2019

Related U.S. Application Data

(63) Continuation-in-part of application No. 29/693,904, filed on Jun. 5, 2019, now abandoned, and a continuation-in-part of application No. 29/692,141, filed on May 22, 2019.

(60) Provisional application No. 62/812,761, filed on Mar. 1, 2019.

(51) Int. Cl.
*A47G 27/02* (2006.01)

(52) U.S. Cl.
CPC ..... *A47G 27/0225* (2013.01); *A47G 27/0206* (2013.01)

(58) Field of Classification Search
CPC ..... A47G 27/0225; A47G 27/0206
USPC ..... 4/251.1, 251.2
See application file for complete search history.

(56) References Cited

U.S. PATENT DOCUMENTS

| | | | | |
|---|---|---|---|---|
| 4,125,656 | A | 11/1978 | Creamer | |
| 4,285,075 | A | 8/1981 | Nelson | |
| 5,282,283 | A | 2/1994 | Atkin | |
| 6,174,581 | B1 | 1/2001 | Barker | |
| 6,295,658 | B1 | 10/2001 | Jenkins | |
| 6,446,275 | B1 * | 9/2002 | Wright | A47G 27/0206 4/251.1 |
| D493,999 | S | 8/2004 | Ruhl et al. | |
| 6,787,210 | B2 | 9/2004 | Stickler | |
| D497,277 | S | 10/2004 | Ruhl et al. | |
| 6,875,494 | B2 | 4/2005 | Burns et al. | |
| D544,282 | S | 6/2007 | Hart, Jr. et al. | |
| 7,597,949 | B2 | 10/2009 | Wright | |
| D625,540 | S | 10/2010 | Dukes | |
| D734,064 | S | 7/2015 | Crevier | |
| 9,259,125 | B2 | 2/2016 | Watkins | |
| 2002/0020016 | A1 | 2/2002 | Lyons | |
| 2002/0142125 | A1 | 10/2002 | Seal | |
| 2005/0009425 | A1 | 1/2005 | Foote | |
| 2006/0029773 | A1 | 2/2006 | Waterman | |
| 2006/0127647 | A1 * | 6/2006 | Thrush | A47G 27/0206 428/172 |
| 2008/0034485 | A1 | 2/2008 | McClelland | |
| 2009/0077728 | A1 | 3/2009 | Garcia | |

(Continued)

FOREIGN PATENT DOCUMENTS

| | | | |
|---|---|---|---|
| WO | WO9641561 | A1 | 12/1996 |
| WO | WO9822280 | A1 | 5/1998 |

*Primary Examiner* — Tuan N Nguyen
(74) *Attorney, Agent, or Firm* — Karen B. Tripp

(57) ABSTRACT

Urinal mat having a flexible, gridded, porous top layer, a disposable, highly liquid-absorbent pad or pad-type middle layer, and an effectively waterproof bottom layer, heavy enough to stay in place without adhesives, and thin enough, with tapered sides, to avoid being a tripping hazard. The top layer fits within a recess in the bottom layer and interlockingly attaches to the bottom layer, with the pad in-between. The interlocking attachment is accomplished by the fitting of horizontal protrusions on the perimeter of the top layer fitting into corresponding peripheral recesses in the bottom layer, and provides a smooth level horizontal top surface of the mat.

14 Claims, 13 Drawing Sheets

(56) References Cited

U.S. PATENT DOCUMENTS

| | | | |
|---|---|---|---|
| 2009/0158512 | A1 | 6/2009 | Crevier |
| 2013/0022775 | A1 | 1/2013 | Dye |
| 2015/0225937 | A1 | 8/2015 | Brown et al. |

* cited by examiner

REUSABLE URINAL MAT WITH REPLACEABLE ABSORBENT PAD

RELATED PATENT APPLICATIONS

The present invention makes reference to, and claims priority from, U.S. Provisional Patent Application Ser. No. 62/812,761, filed Mar. 1, 2019, U.S. Design patent application Ser. No. 29/692,141, filed May 22, 2019, and U.S. Design patent application Ser. No. 29/693,904, filed Jun. 5, 2019.

BACKGROUND OF THE INVENTION

1. Field of the Invention

The present invention relates to a urinal mat, and more particularly to a mat having a disposable and replaceable pad for absorbing fluids that would otherwise be deposited on the floor, to protect the floor from stains or damage, and to maintain safe and sanitary conditions.

2. Description of Relevant Art

The problem of moisture accumulation around the base of a urinal wherein such moisture leaves an unsightly appearance and oftentimes renders the area unsanitary and even unsafe is well known. The problem arises, in the first instance, due to condensation of water on the outer surface of a urinal, the water gravitating to the base of the urinal and then onto the floor surrounding the base. The problem also arises when persons who use the urinal do not or cannot avoid some spillage or dripping outside the urinal.

The problem is particularly acute in public institutions, rest homes and the like having young children, or elderly or physically infirm persons. Additionally, business establishments, and particularly restaurants and gas stations whose restrooms receive a lot of traffic, have an essentially continuous burden of attempting to keep their restrooms clean, attractive, and sanitary for their customers. Collection of urine beneath a urinal or adjacent the base of a urinal causes unpleasant odor as well as stains on the floor, which often also results in damage or permanent discoloration to the floor. Further, such spillage or dripping onto the floor is often spread by a user's shoes to other areas of the restroom floor as well as to other non-restroom floors, and if left untouched over periods of time can result in unsanitary bacterial growth.

Various urinal mats have been proposed over the years in an effort to address these problems and concerns. Such attempts, for the most part, have been directed to the use of pads that are bulky, indisposable, or are not sufficiently adjustable to be useful with toilets having bases of different sizes. Further, prior art solutions tend to provide mats either so thick as to be tripping hazards or so light in weight and/or slippery as to end up sliding to locations away from the toilet. When such prior art mats and devices are affixed to the floor, such affixing materials can damage the floor and such affixing of the mats or devices makes the mats or devices and the underlying floor more difficult to clean. Consequently, few mats are in actual commercial use, and the problems continue.

SUMMARY OF THE INVENTION

The present invention provides a mat for positioning beneath a wall-hung urinal, or adjacent the base of a floor mounted urinal. The mat is particularly suited for catching and absorbing condensed moisture associated with the urinal and also for catching and absorbing urine spillage or drips not received into or splashed out of the urinal.

The mat of the invention is thin and flexible and heavy, with tapered sides and edges, so that it is not a tripping hazard to persons walking near or on it and so that it stays in place on the floor without adhesives or other affixers. For clean-up, one need only pick up the mat and clean the floor, as well as clean the mat when and as needed.

The mat of the invention has a thin, flexible, horizontal top layer, an underlying highly liquid-absorbent, disposable pad, preferably with a water-proof base or bottom layer, and a thin, flexible, horizontal, solid, waterproof, bottom section. The top layer is substantially comprised of a porous grid or open-work within a solid perimeter border. The holes of the open-work or in the grid are sufficiently large to allow liquids such as urine to readily pass through the top layer to the absorbent pad beneath, but not so large that persons walking on the mat effectively touch or directly walk on the top surface of the pad.

The pad is substantially flat, at least slightly compressible, horizontal, disposable, and replaceable, and is comprised of highly liquid-absorbent synthetic material such as for example a sodium polyacrylate polymer. Preferably, or at least in one embodiment, the pad has a bottom layer, film or sheet that is impermeable to liquids, and the side of the pad with this layer is positioned adjacent the bottom section of the mat. The pad should be sized to substantially match the overall shape of the top layer of the mat, or be smaller than the top layer, but most preferably the pad is at least as large as the size of the grid or open-work section of the top layer.

In one embodiment, the top layer and bottom section are comprised of flexible, heavy-duty rubber or rubber-like synthetic material, which is waterproof or effectively waterproof. Similar heavy-duty, waterproof materials could alternatively be used.

The bottom section has tapered peripheral sides, preferably or at least in one embodiment, for example, less than or about ½ inch in thickness or height, that extend from the bottom to the top layer and end with a flat horizontal peripheral border around a recessed central body in the bottom section for receiving the top layer and the pad. Thus, the top layer and pad are smaller than the bottom section of the mat, and the top layer is sized to match the recessed central body of the bottom section such that the top layer fits snugly but removably inside the recessed central body of the bottom section. The top layer also fits substantially evenly in the recessed central body of the bottom section of the mat, within the peripheral border of that bottom section, such that when the top layer is fitted inside the bottom section, with the pad underlying the top layer—that is, both the top layer and pad are within the recessed central body of the bottom section—the top layer is essentially or substantially level and flat in a horizontal plane with the peripheral border of the bottom section and mat.

The perimeter border of the top layer has one or more horizontal protrusions or recesses on at least two opposing sides of the perimeter border. These correspond to, and interlock with, horizontal recesses or protrusions on at least two opposing sides of the peripheral border of the bottom section, so as to interlock the top layer to the bottom section and to secure the top layer in place on the bottom section. This interlocking closure secures the pad within the top layer and the bottom section of the mat for use.

BRIEF DESCRIPTION OF THE DRAWINGS

The drawings constitute a part of this specification and include exemplary embodiments to the invention, which may be embodied in various forms. In some instances, various aspects of the invention may be shown exaggerated or enlarged to better facilitate an understanding of the invention. Since the invention can be embodied in many forms without departing from the spirit of essential characteristics indicated above, it should be understood that the drawings are for purposes of illustration and description and are not intended as a definition of the limits of the invention.

LIST OF ELEMENTS IN THE FIGURES

Figure 1:
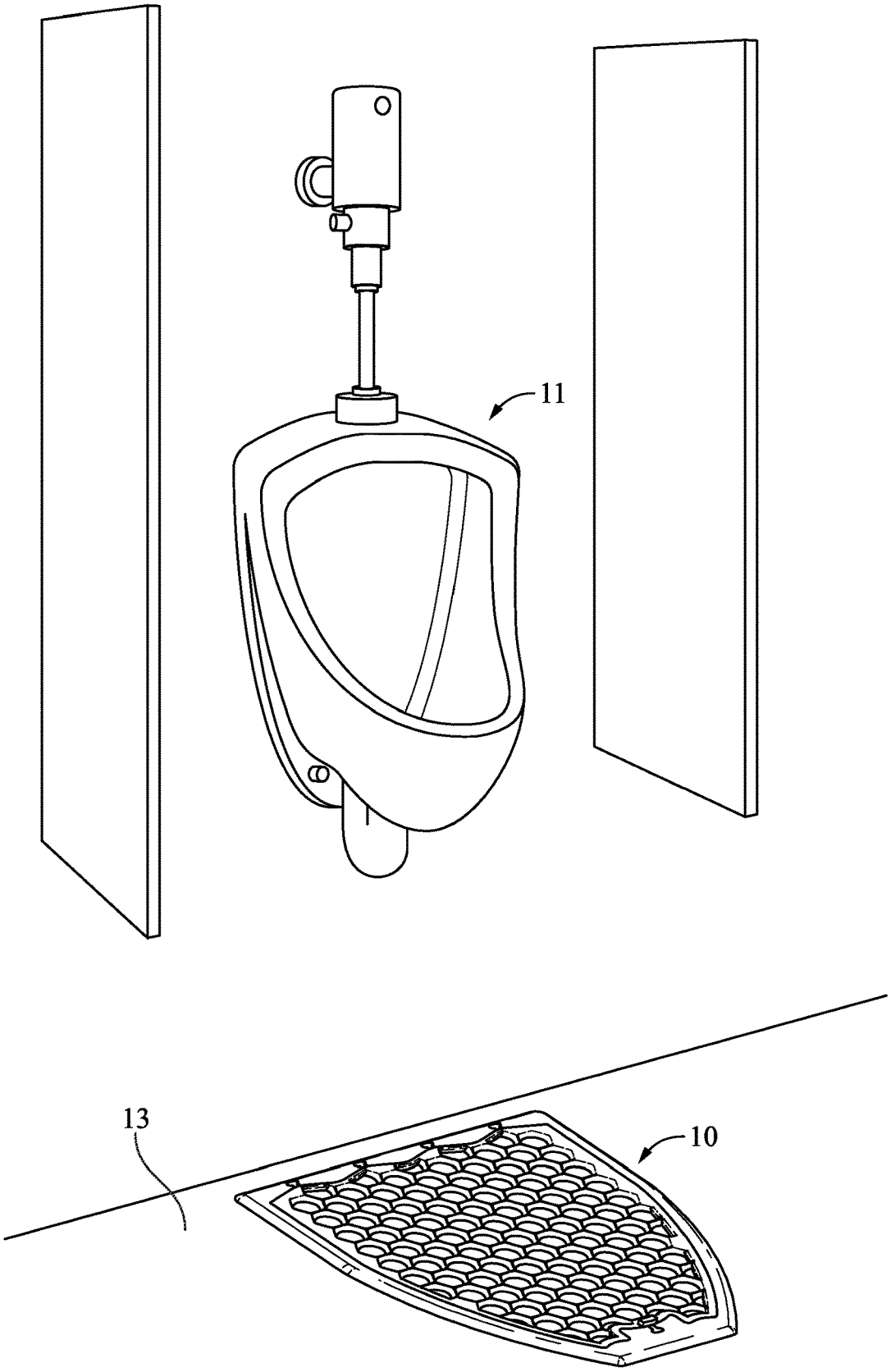
FIG. 1 is a perspective view of one embodiment of the mat of the invention in position on a floor beneath a urinal.
Figure 2:
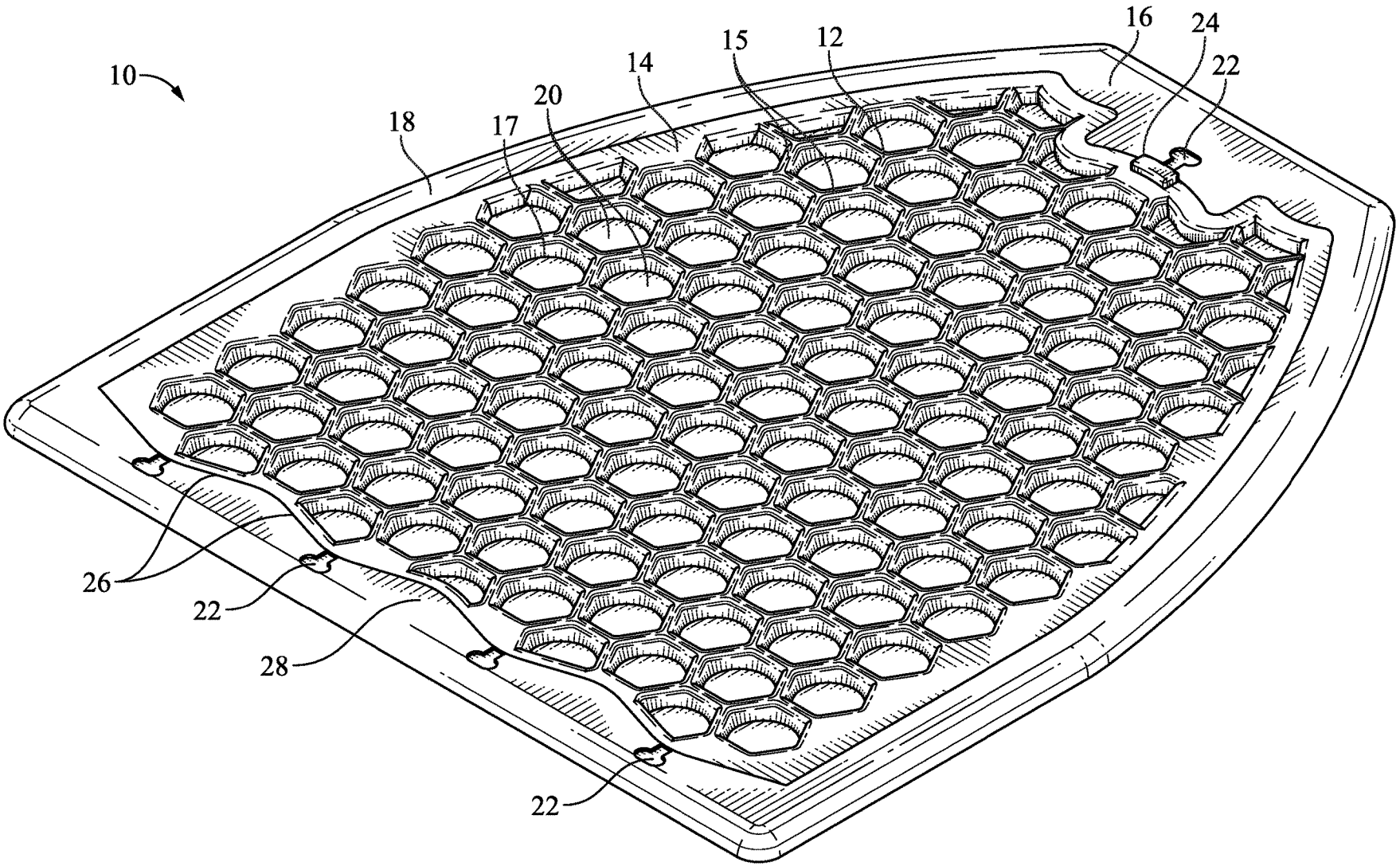
FIG. 2 is an enlarged top perspective view of the mat of FIG. 1.
Figure 4:
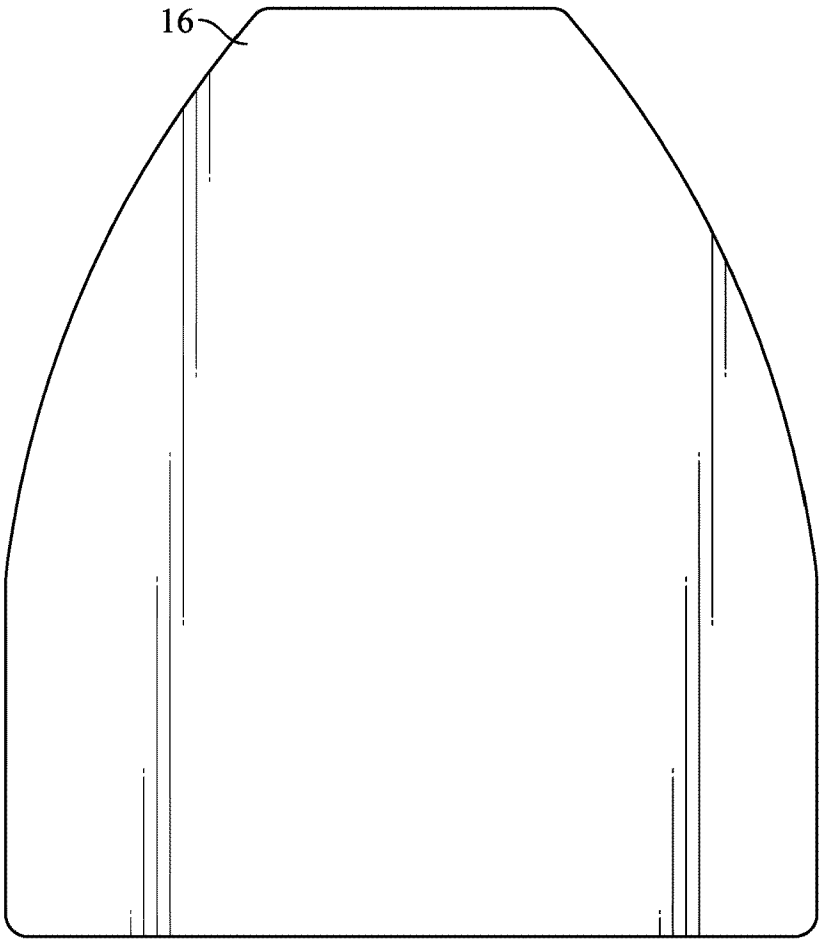
FIG. 4 is a back view of the mat of FIG. 1.
Figure 3:
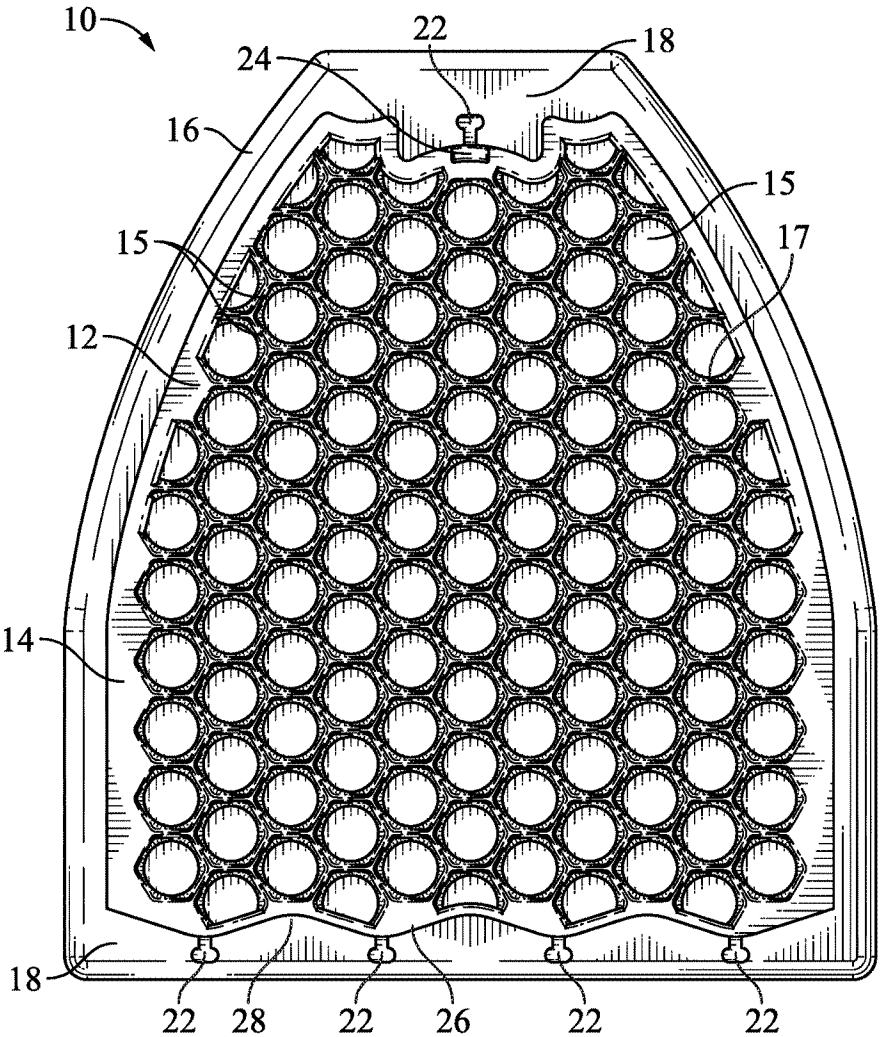
FIG. 3 is top view of the mat of FIG. 1.
Figure 5:
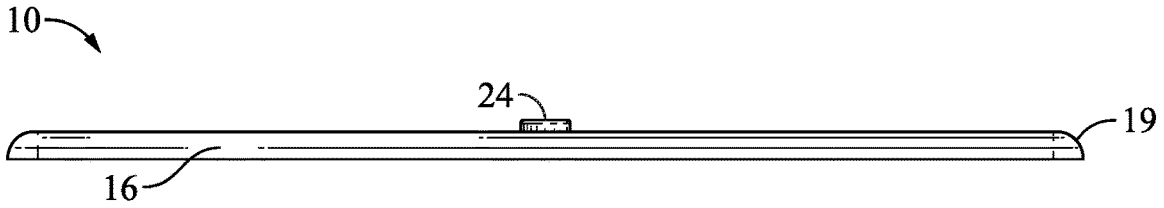
FIG. 5 is an end view of the mat of FIG. 1.
Figure 6:
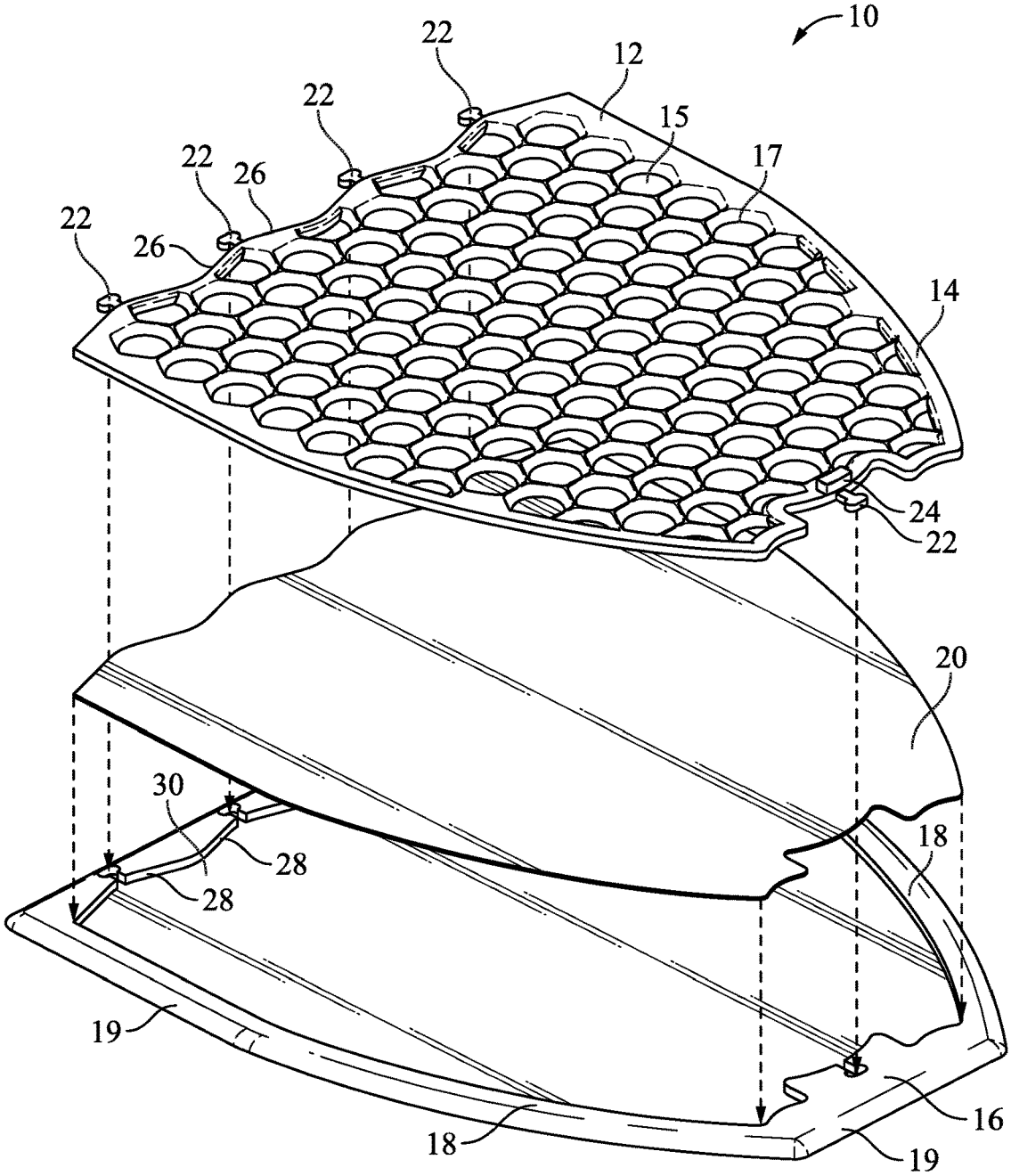
FIG. 6 is a disassembled view of the mat of FIG. 1, showing three separate parts, a top layer, a pad, and a bottom section.
Figure 7:
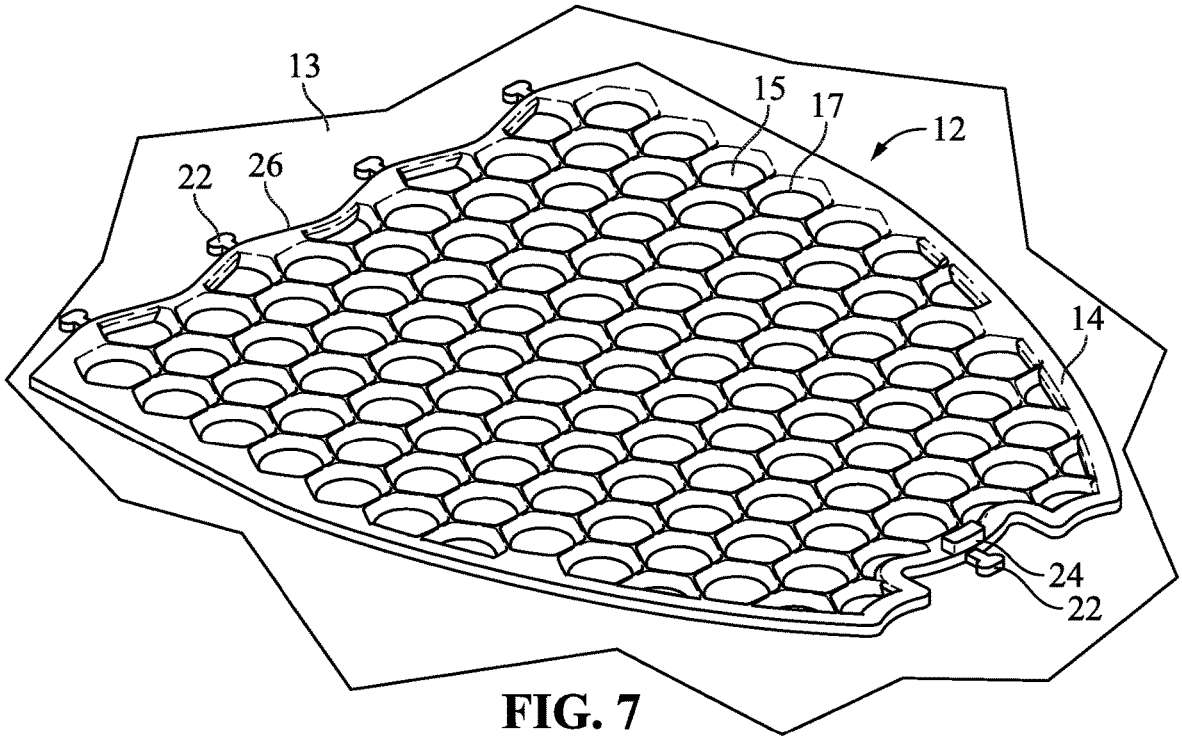
FIG. 7 is a top perspective view of the top layer of the mat of FIGS. 1 and 6, separated from the pad and the bottom section of the mat.

10 One embodiment of the mat of the invention
11 Urinal
12 Top layer of the mat
13 Floor
14 Perimeter border of the top layer of the mat
15 Grid or open-work of the top layer of the mat
16 Bottom section of the mat
17 Hole in the grid or open-work of the top layer of the mat
18 Periphery border of the bottom section of the mat (and of the mat)
19 Tapered side of the bottom section of the mat (and of the mat)
20 Pad
21 Waterproof bottom layer of pad
22 Protrusion of the top layer of the mat
24 Lip
26 Wavy edge or side of perimeter border of top layer of the mat
28 Wavy edge or side of periphery border of the bottom section of the mat
30 Recessed central body of the bottom section of the mat
32 Wall of grid or open-work of the top layer of the mat
34 Recess of the bottom section of the mat for interlocking with a corresponding protrusion of the top layer of the mat
40 Alternative embodiment of mat of the invention having a "U" shape
41 Top layer of "U" shaped mat
42 Pad of "U" shaped mat
43 Bottom section of "U" shaped mat
44 Alternative embodiment of mat of the invention having an irregular hexagonal shape
45 Top layer of hexagonal shaped mat
46 Pad of hexagonal shaped mat
47 Bottom section of hexagonal shaped mat
48 Alternative embodiment of mat of the invention having an octagonal shape
49 Top layer of octagonal shaped mat
50 Pad of octagonal shaped mat
51 Bottom section of octagonal shaped mat
52 Alternative embodiment of mat of the invention having a rectangular shape
53 Top layer of rectangular shaped mat
55 Pad of rectangular shaped mat
56 Bottom section of rectangular shaped mat

DESCRIPTION OF PREFERRED EMBODIMENTS

The present invention provides a mat for use with urinals to maintain the floor area around such facilities in a clean condition, by readily absorbing and holding moisture and liquids that drip onto the mat, while allowing easy clean-up as explained further below.

As can be seen from the Figures, the mat of the invention can be made in a wide variety of shapes and forms, including for example, square, circular, triangular, hexagonal, octagonal or other regular, polygonal or irregular polygonal shape, or even a combination of these, such as a mat that is partially curved or oval in shape and partially straight edged or polygonal in shape. Preferably, the mat of the invention has a form that allows it to closely fit adjacent to or generally beneath the urinal.

Advantageously, the mat of the invention is sufficiently thin and has a smooth, sloping and/or tapered edge such that the mat is not a tripping hazard, and the mat is sufficiently heavy that it does not readily slip or move so that it can easily remain in place without adhesives or other attachments to the floor beneath. In one embodiment for use with a single urinal, for example, the mat weighs in the range of about 3 to about 10 pounds.

The body of the mat, that is, the top layer (in the Figures for illustration, 10, 41, 45, 49, and 53) and the bottom section (in the Figures for illustration, 16, 43, 47, 51, and 56), are preferably fabricated from a material comprised of smooth, resilient rubber or synthetic rubber, or silicone rubber, or alternatively a soft-type of plastic, silicone, aluminum, iron, or wood or treated wood. The material should be "heavy-duty," meaning that it should be resilient enough to support the weight of a person standing on it, or up to about 350 to 400 pounds, without permanent deformation of the grid shape, and it should be a material that itself is easily cleanable and not absorbent, and waterproof or effectively waterproof.

The body of the mat houses an absorbent pad, which is preferably comprised of a highly absorbent material that can hold multiple times its weight in water without disintegrating over several days time. Examples include absorbent materials developed for diapers, and absorbent pads developed for protecting beds from bed-wetting or for house training dogs. Such materials typically comprise polyester or sodium acrylate polymers (often the primary material), cotton, paper, wool, carbon fiber, absorbent polymer, plastic, rubber, and synthetic rubber. Preferably, the absorbent pad has a liquid (or at least water and urine)—impenetrable base or base layer, film or sheet, typically comprised of plastic. The side of the pad with such impenetrable sheet is positioned adjacent the bottom section of the mat to avoid leakage into the body of the mat.

After use, the absorbent pad is removed from the mat body and disposed of. The body of the mat is also preferably then rinsed off, and a fresh pad installed.

FIG. 1 illustrates one embodiment of the mat of the invention, mat 10, as shown in use with a urinal 11. Referring to FIGS. 2-14, mat 10 is shown in detail to illustrate the invention. Mat 10 comprises a top layer 12 having a porous grid or open-work 15 within a solid perimeter border 14. The holes 17 of the open-work or grid 15 are sufficiently large to allow liquids such as urine to readily pass through the top layer 12 to an absorbent pad 20 beneath, but not so large that persons walking on the mat effectively touch or directly walk on the top surface of the pad 20. Top layer 12 thus effectively serves as a type of protective cover for the pad, although top layer 12 allows the pad 20 to receive direct contact with liquids dripping onto the mat.

Figure 8:
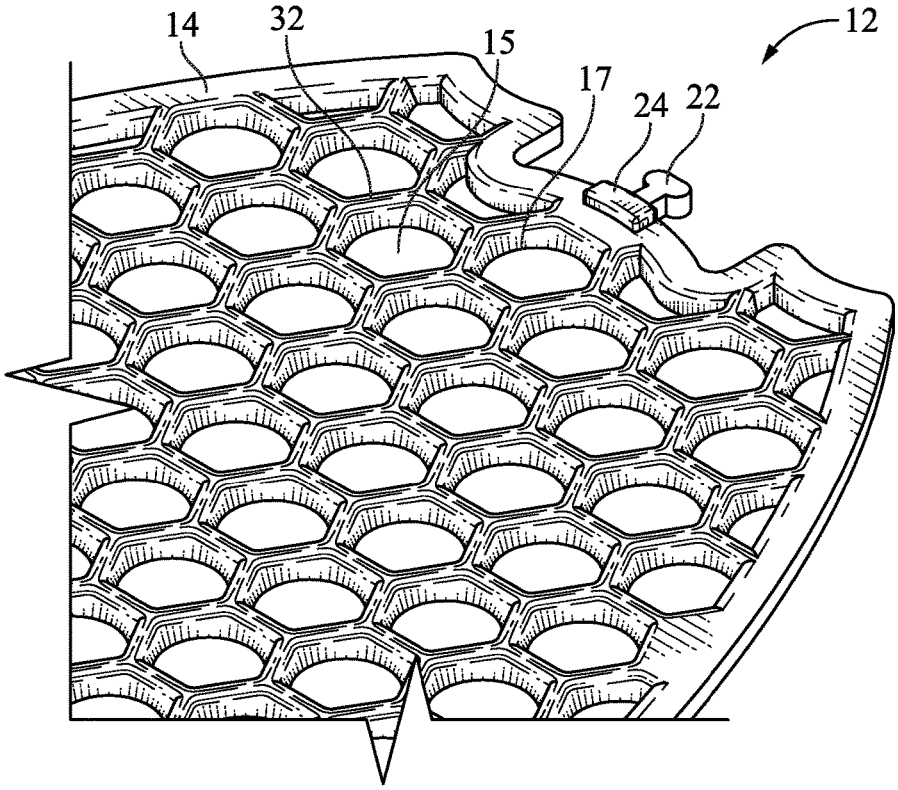
FIG. 8 is a close up, enlarged view of a portion of the open-work or grid of the top layer of the mat of FIG. 7.
Figure 9:
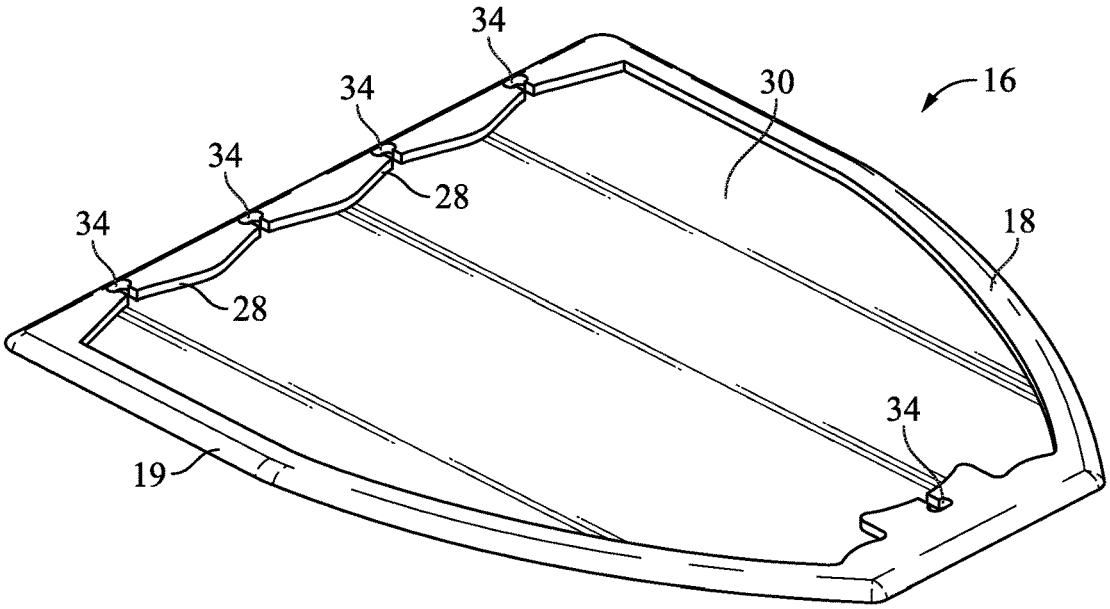
FIG. 9 is a top view of the bottom section of the mat of FIGS. 1 and 6, separated from the pad and the top layer of the mat, and showing the recessed body of the bottom section of the mat.
Figure 10:
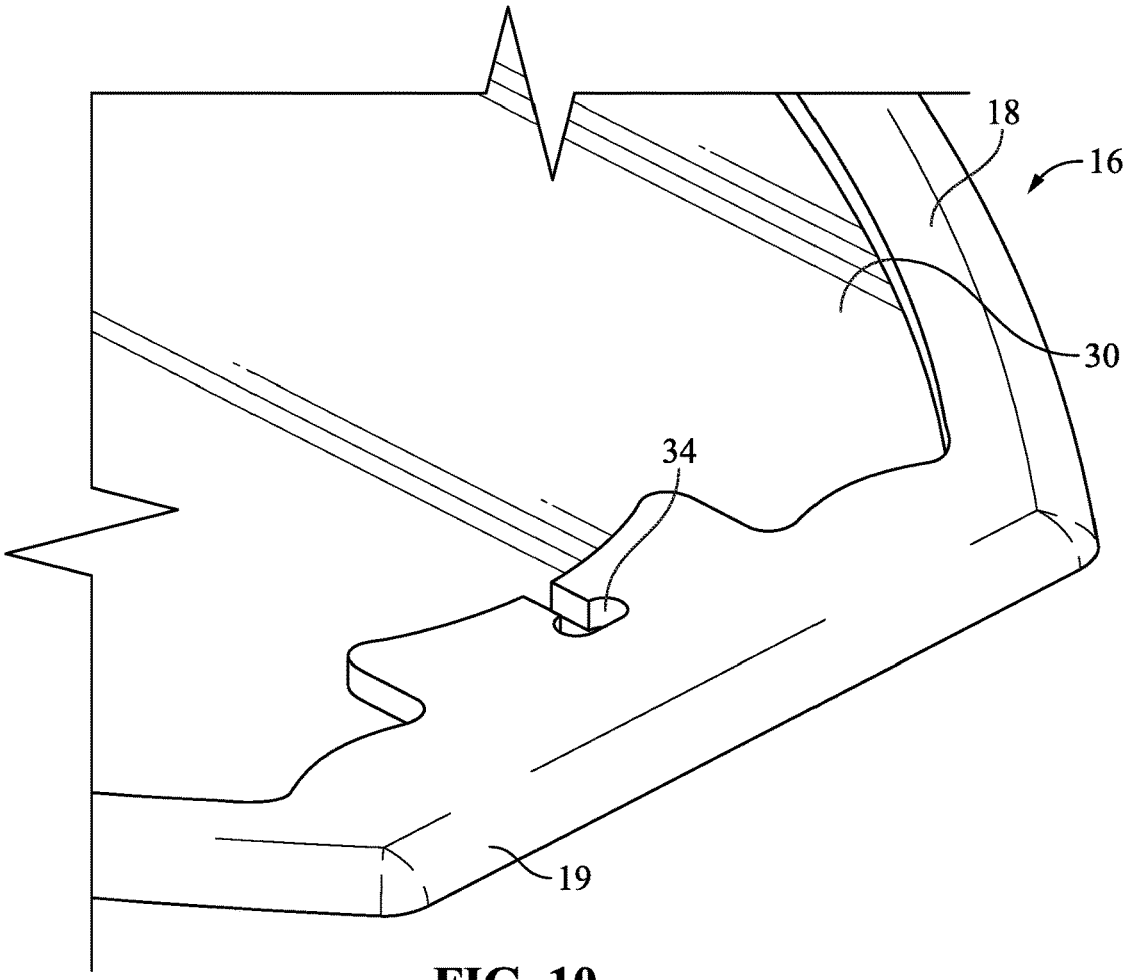
FIG. 10 is a close up, enlarged top perspective view of the front portion of the bottom section of the mat of FIG. 9.
Figure 11:
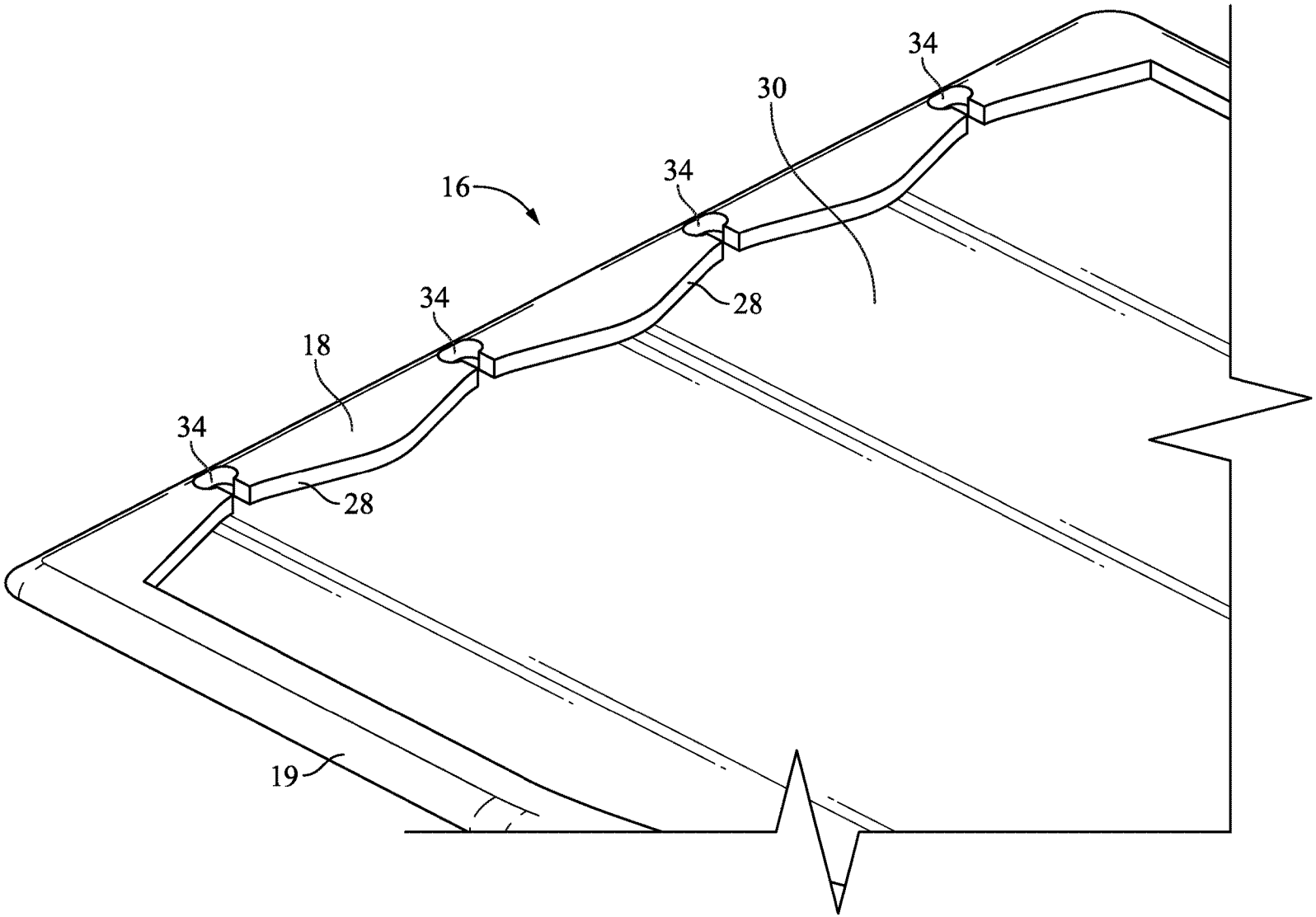
FIG. 11 is a close up, enlarged top perspective view of a back portion of the bottom section of the mat of FIG. 9.
Figure 12:
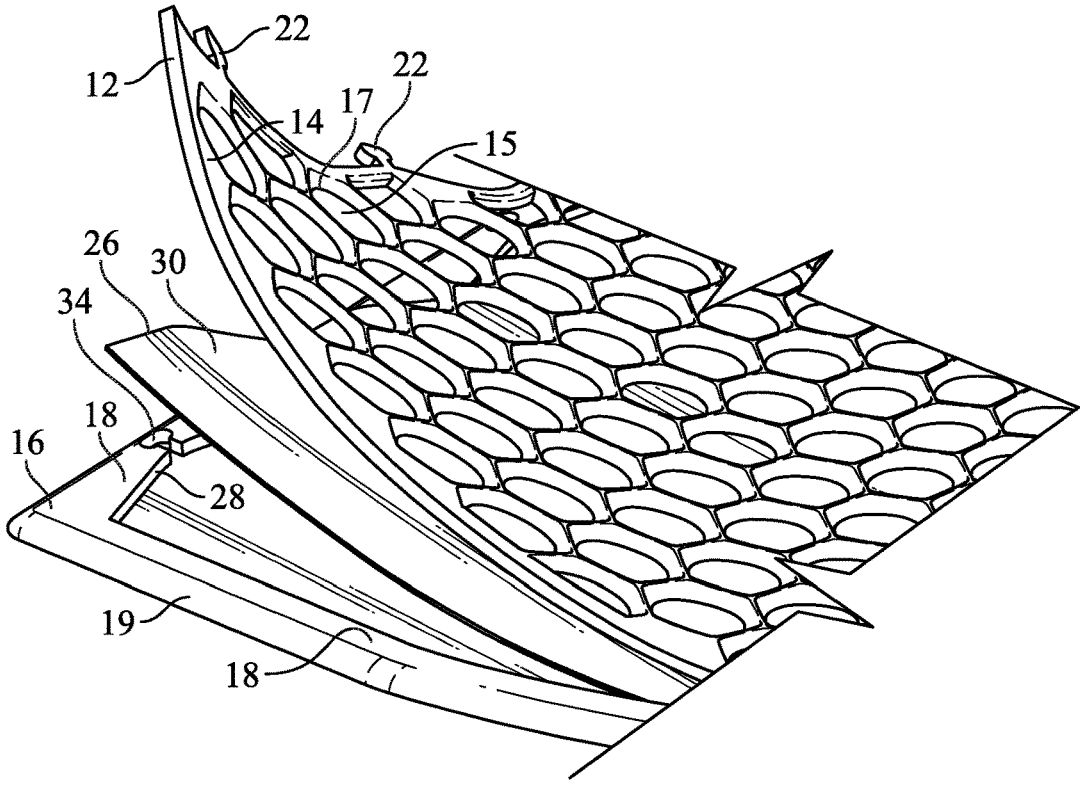
FIG. 12 is close up, enlarged top back perspective view of a portion of the mat of FIG. 2, just as the top layer is being position in interlocked attachment to the bottom section.
Figure 13:
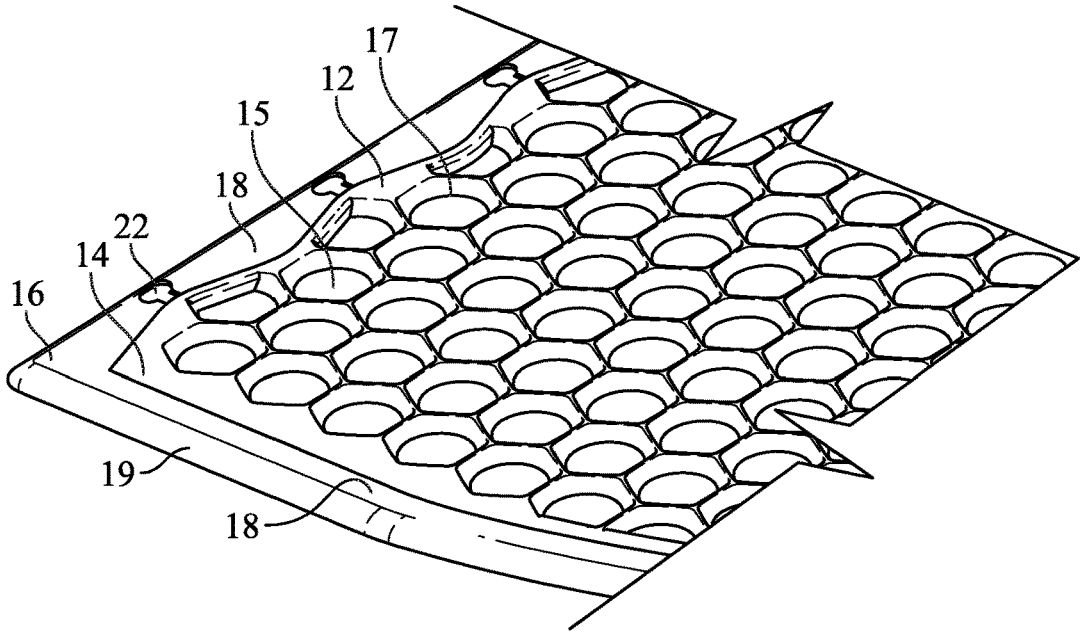
FIG. 13 is close up, enlarged top back perspective view of the mat of FIGS. 2 and 12, after the top layer has been positioned in interlocked attachment to the bottom section.
Figure 14:
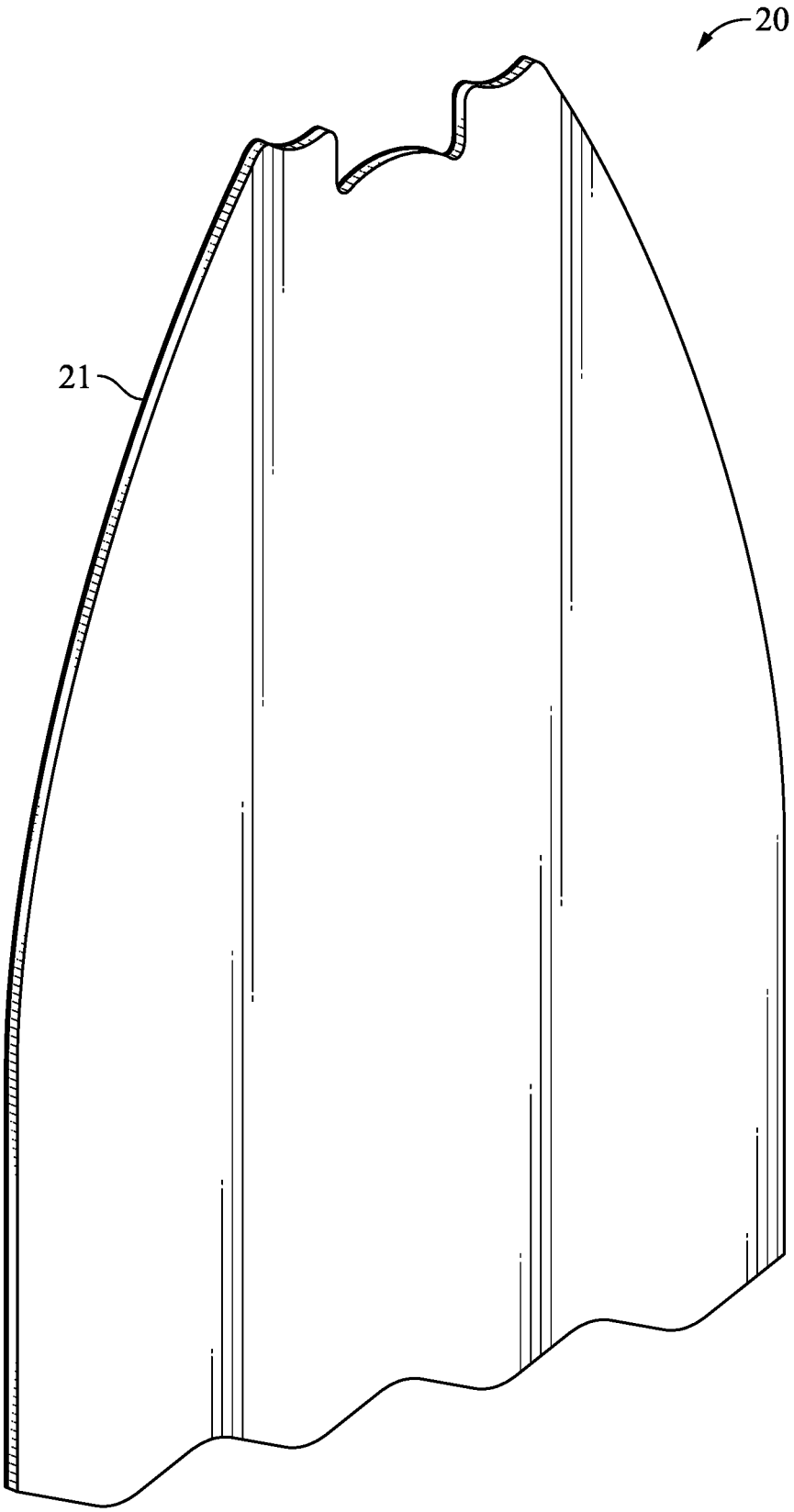
FIG. 14 is a top perspective view of the pad of FIGS. 1 and 6.
Figure 15:
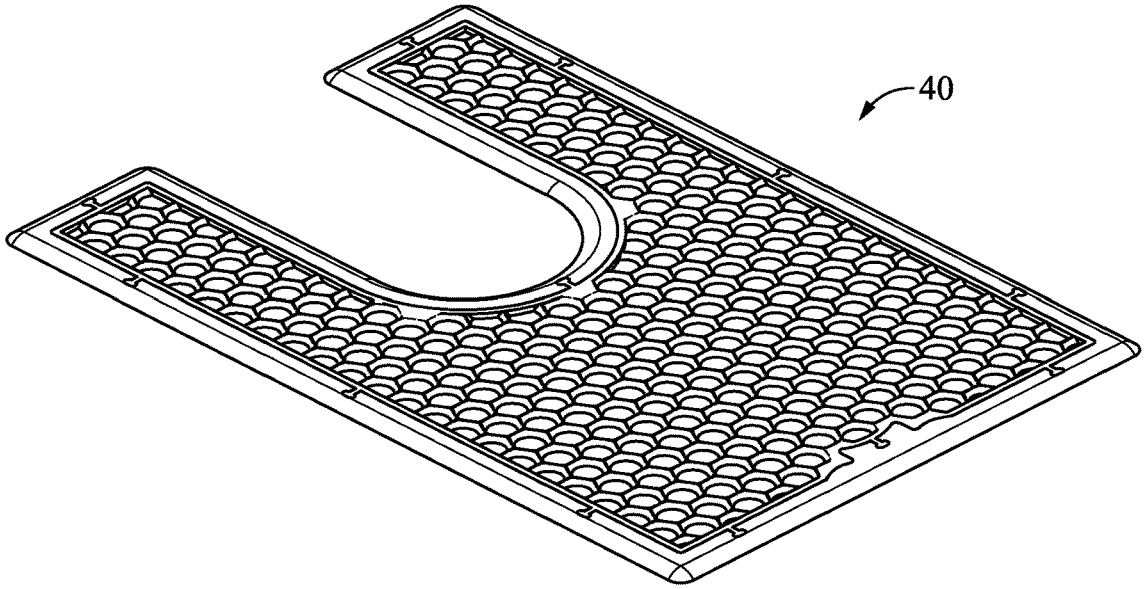
FIG. 15 is an alternative embodiment of the mat of the invention, in a "U" shape.
Figure 16:
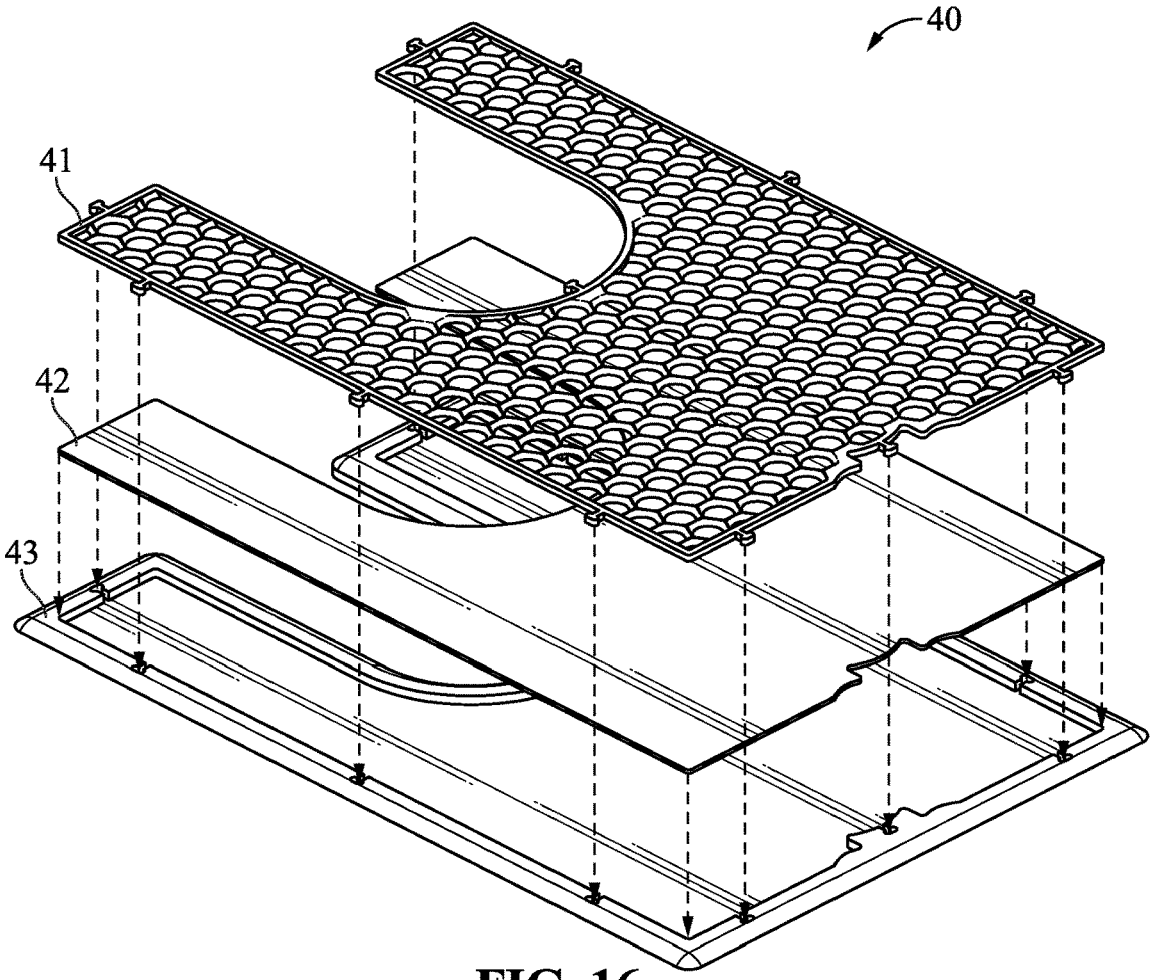
FIG. 16 is the mat of FIG. 15 blown apart to show its three parts, a top layer, a pad, and a bottom section.
Figure 17:
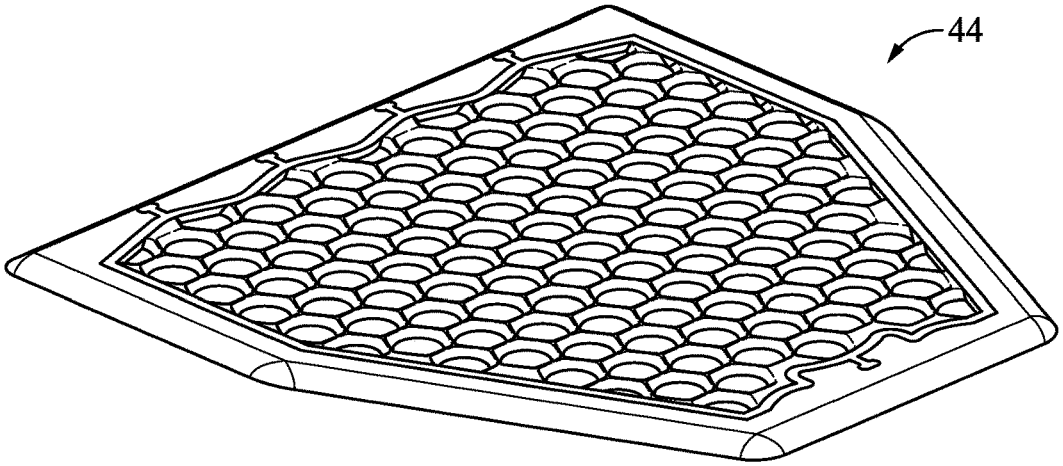
FIG. 17 is another alternative embodiment of the mat of the invention, in a polygonal or irregular hexagonal shape.
Figure 18:
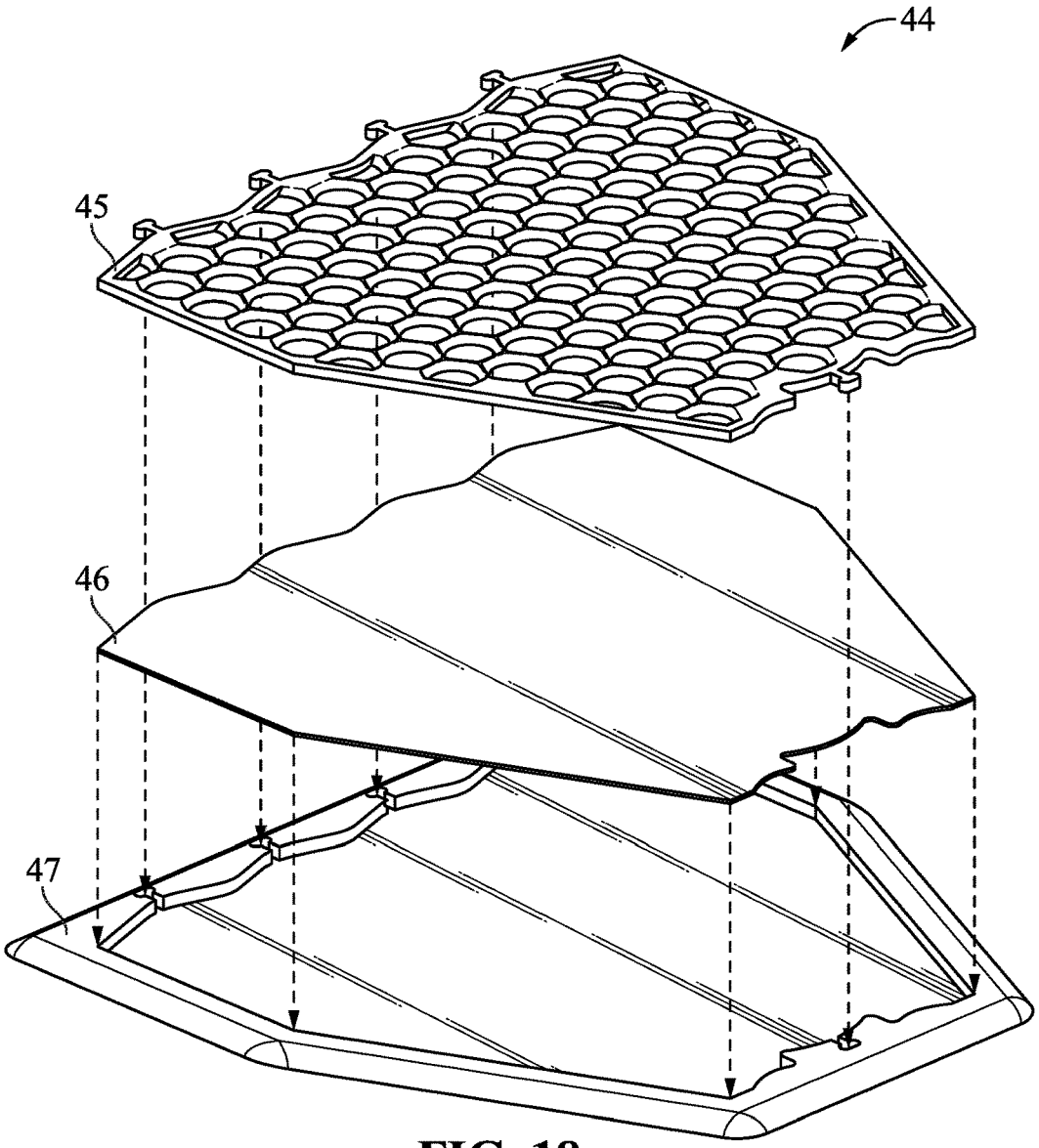
FIG. 18 is the mat of FIG. 17 blown apart to show its three parts, a top layer, a pad, and a bottom section.
Figure 19:
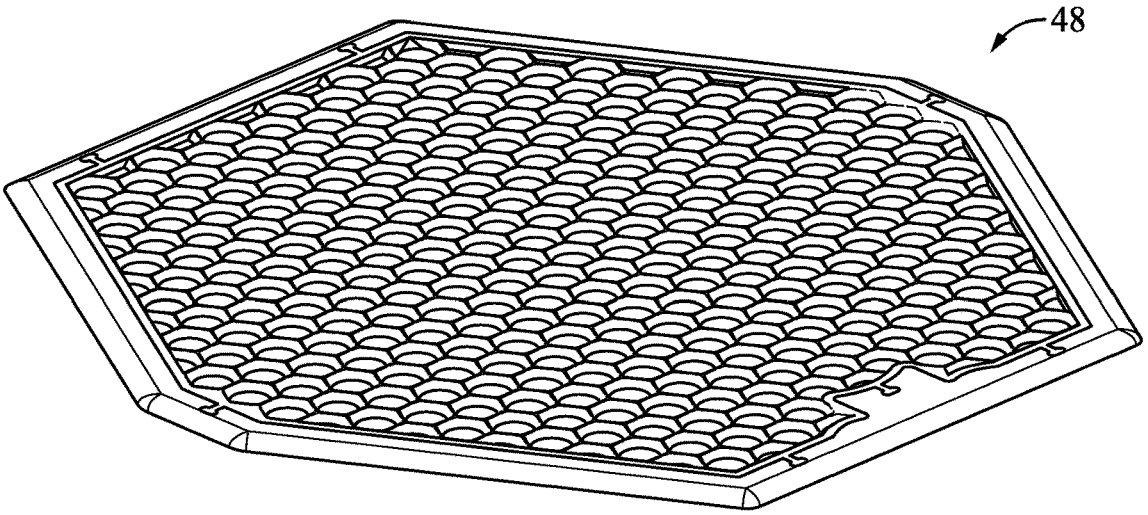
FIG. 19 is still another alternative embodiment of the mat of the invention, in a regular hexagonal shape.
Figure 20:
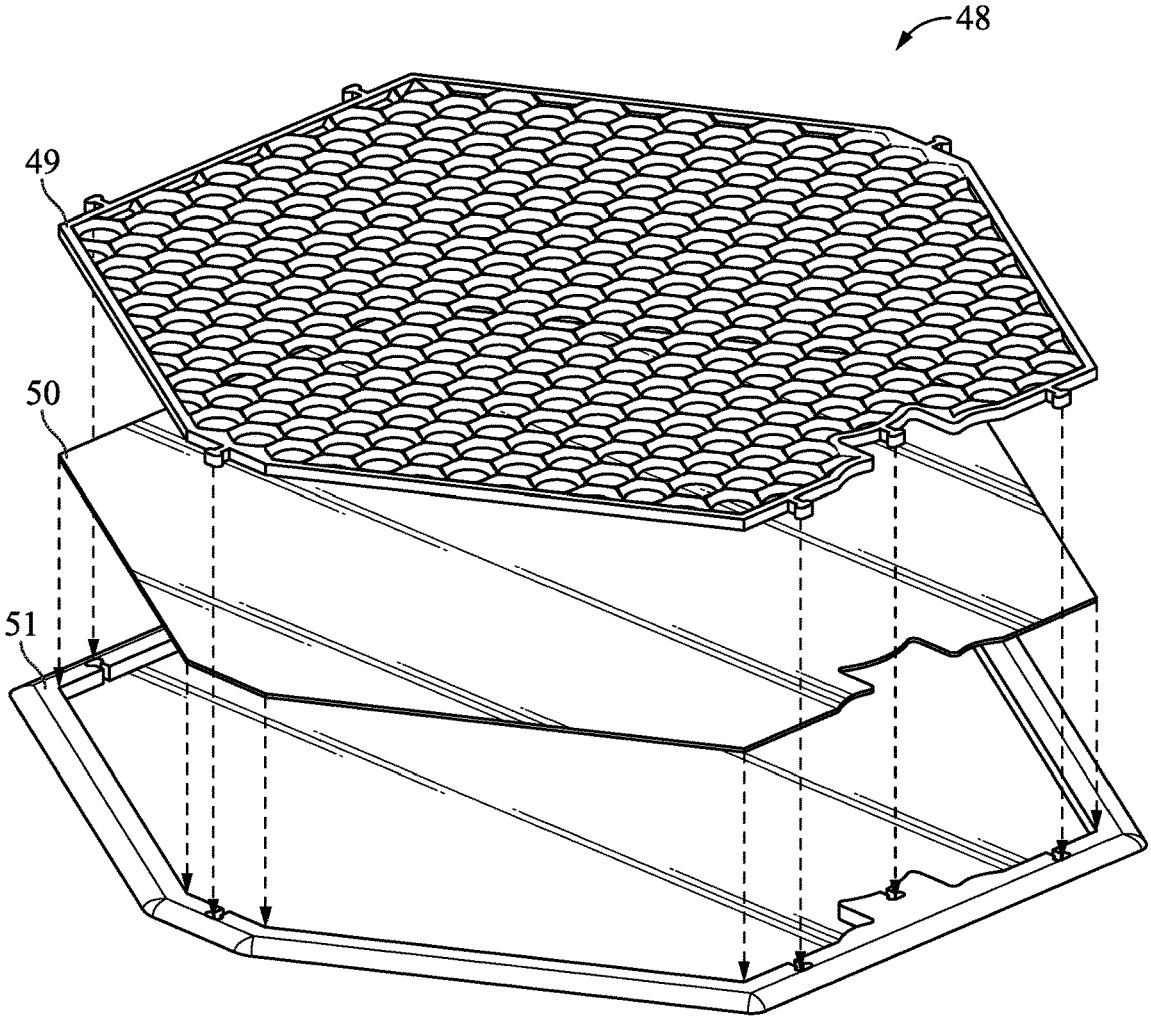
FIG. 20 is the mat of FIG. 19 blown apart to show its three parts, a top layer, a pad, and a bottom section.
Figure 21:
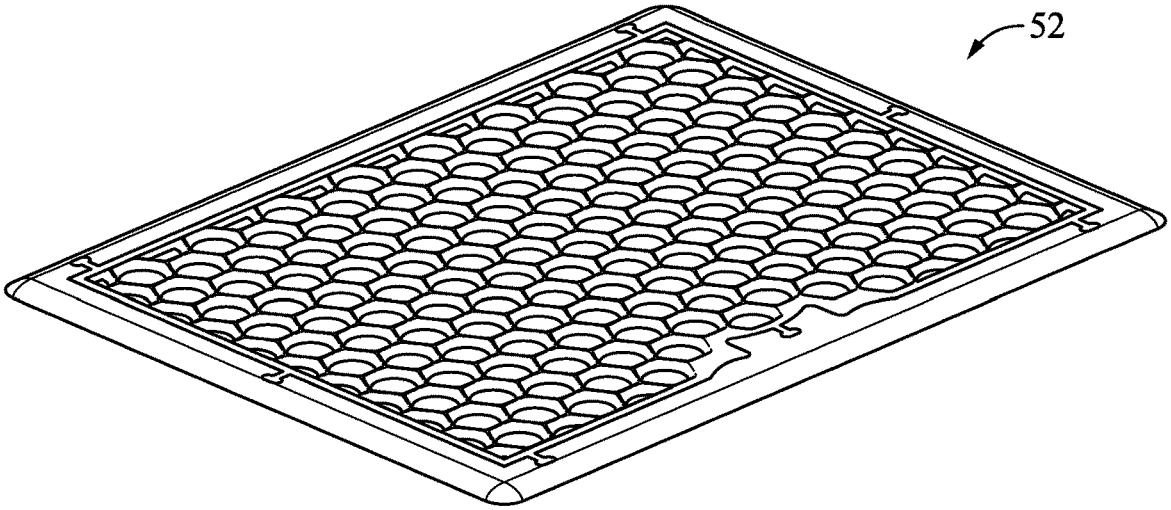
FIG. 21 is a further alternative embodiment of the mat of the invention, in a rectangular shape.
Figure 22:
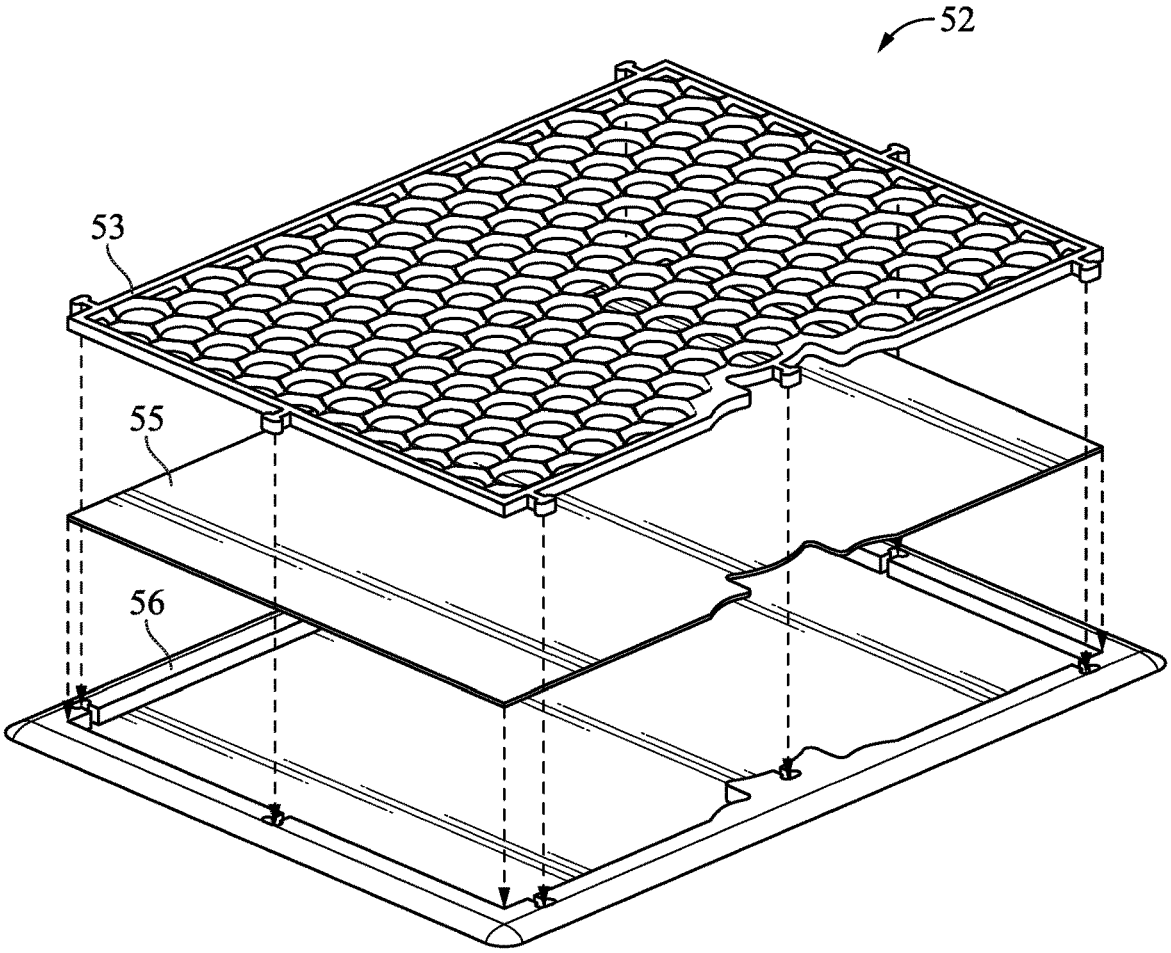
FIG. 22 is the mat of FIG. 21 blown apart to show its three parts, a top layer, a pad, and a bottom section.

The grid or open-work 15 can have a symmetrical pattern or a varied and unsymmetrical pattern. In one embodiment, the holes 17 of the grid or open-work 15 range for example from about ⅛ inch to 2 inches in diameter. In another embodiment, the holes 17 for example are all about 1½ inches in diameter (except in certain areas adjacent the perimeter border), as shown in mat 10 in FIGS. 2, 3, 7, and 8. As shown in FIG. 8, the holes 17 of mat 10 and the walls 32 of the grid or open-work 15 forming those holes 17, have, in this embodiment, a hill-type or convex vertical shape to direct fluids through the grid or open work 15 to the underlying pad 20 for absorption.

Pad 20 is substantially flat, at least slightly compressible, horizontal, disposable, and replaceable. The pad should be sized to substantially match the overall shape of the top layer 12 of mat 10, or be smaller than top layer 12, but most preferably pad 20 is at least as large as the size of the grid or open-work 15 of top layer 12. (To save manufacturing costs of the pad, the pad 20 need not have protrusions to match the protrusions 22 in the top layer 12, which will be discussed further below, although in some embodiments, such protrusions in the pad might further help hold the pad in the desired position within the mat).

The bottom section 16 of mat 10 has tapered peripheral sides 19, which also constitute the outer or peripheral sides of the body of mat 10 as the bottom section 16 fully encases the sides of top layer 12. Peripheral sides 19 extend from the base of the bottom section 16 (adjacent the floor 13) to the top surface (or slightly above the top surface) of the top layer 12 and end with a flat horizontal peripheral border 18 around a recessed central body 30 in the bottom section 16 for receiving the top layer 12 and the pad 20. Thus, the top layer 12 and pad 20 are smaller than the bottom section 16 of the mat 10, and the top layer 12 is sized to match the recessed central body 30 of the bottom section 16 such that the top layer 12 fits snugly but removably inside the recessed central body 30 of the bottom section 16.

The top layer 12 also fits substantially evenly in the recessed central body 30 of the bottom section 16 of the mat 10, within the peripheral border 18 of that bottom section 16, such that when the top layer 12 is fitted inside the bottom section 16, with the pad 20 underlying the top layer 12, and both the top layer 12 and pad 20 are within the recessed central body 30 of the bottom section 16, the top layer 12 (particularly the top surface of top layer 12) is essentially or substantially level and flat in a horizontal plane with the peripheral border 18 of the bottom section 16 and mat 10.

In one embodiment, for example, the overall mat 10 of the invention sized for use with one urinal is less than or about ½ inch in height and weighs in the range of about 3 pounds to about 10 pounds. In that embodiment, the top layer 12 portion of the mat 10 has a height of less than or about ¼ inch and weighs in the range of about 1 to about 3 pounds, while the bottom section 16 of the mat 10 weighs in the range of about 2 to about 7 pounds. In preferred embodiments, the top layer has a height less than or about half the height of the sides 19 of the bottom section 16 of the mat 10.

The perimeter border 14 of the top layer 12 in mat 10 has one or more horizontal protrusions 22 or recesses (not shown), preferably on at least two opposing sides of the perimeter border as shown for example in FIGS. 1, 2, 6, and 7. These protrusions 22 or recesses correspond to, and interlock with, horizontal recesses 34 or protrusions (not shown) on the peripheral border 18 of the bottom section 16, so as to interlock the top layer 12 to the bottom section 16 and to secure the top layer 12 in place on the bottom section 16. Lip 24 helps facilitate lifting the top layer 12 off and out of the bottom section 16.

While in the Figures, the perimeter border 14 of the top layer 12 has protrusions 22, rather than recesses, interlocking with recesses 34 (rather than protrusions) in the peripheral border 18 of the bottom section 16, the interlock of the top layer 12 to the bottom section 16 could alternatively be effected with recesses in the perimeter border 14 interlocking with protrusions in the peripheral border 18, although such alternative is not shown in the Figures.

It is contemplated in embodiments as described as shown in the Figures that one of the borders 15 and 18 will have protrusions and the other will have corresponding recesses. However, a further alternative embodiment similarly effective at interlocking the top layer to the bottom section would have at least one recess and at least one protrusion in the top layer perimeter border for corresponding to and interlocking with at least one protrusion and at least one recess in the bottom section peripheral border, respectively. Still further, while the embodiments shown in the drawings have interlocking protrusions 22 and recesses 34 on opposing sides or ends of the mat, in an alternative embodiment, interlocking protrusions and recesses could be provided on every side or end of the mat.

In still another embodiment, one or more interlocking protrusions and recesses could be provided only on one end of the mat. In that embodiment, the top layer would be connected to the bottom section of the mat by other means, such as for example, by an extruded hinge. That is, the top layer and the bottom section could be formed as one piece with a fold to allow the top layer to overlap the bottom section. In that embodiment, the interlocking protrusion and recess connection could be limited if desired to use on the opposing end opposite such fold or extruded hinge only, or could be used on other sides also.

The interlocking connection of the top layer to the bottom section of the mat of the invention enables some of the significant advantages of the invention. Such connection avoids connectors or attachment parts that can become rusty or get lost or that can be raised above the mat and cause a tripping hazard. Further, the interlocking connection, which can be built into the mold or formed in the extrusion of the body of the mat, enables a lower manufacturing cost for the mat than providing attachers or connectors that must be affixed to the mat.

The interlocking connection of the top layer 12 to the bottom section 16 of mat 10 described is shown in the FIGS. 2, 3,6, 7, 9, 12 and 13 to be effected with protrusions 22 and recesses 34 having a mushroom or "T" shape. However, other shapes could alternatively be used provided the shape has some "hook" element that effects, accomplishes or otherwise allows or enables the interlock. For non-limiting example, such "hook" might be effected with any "letter-of-the-alphabet" shape. Where the mat is comprised of a material such as rubber or synthetic rubber having some flex as well as a dense and/or somewhat soft texture that enables a tight fit, shapes without a hook element could also be alternatively used.

The interlocking connection of the top layer 12 to the bottom section 16 of mat 10 is believed to be strengthened by the wavy, zig-zag or irregular shaped edge, rather than a curved or straight edge, of the sides 26 of the perimeter border of the top layer having the first horizontal protrusions and the corresponding sides 28 of the periphery border of the bottom section having the horizontal recesses for interlocking. These irregular edges or sides 26 and 28 compliment, correspond and relate one to the other of the top layer and the bottom section such that the edges 26 of the perimeter border and the edges 28 of the periphery border fit together in an interlocking type style further securing the interlocking fit of the top layer 12 to the bottom section 16.

In the embodiments shown in the Figures, the mat bodies of mats 10, 40, 44, 48, and 52 of the invention are manufactured by molding or extrusion such that the bottom section and the top layer on the mats consist of two pieces which after interlocking together substantially look like a one piece mat body, having: (a) tapered peripheral edges; (b) a flat, horizontal, and porous top; and (c) a flat, horizontal, and solid, waterproof bottom. This simplicity of design afforded by the interlocking connection not only saves manufacturing costs, but also makes the mats easier and thus also more economical to clean.

The embodiments shown in the Figures generally contemplate and show single mats for positioning beneath a single wall hung urinal or adjacent a single floor mounted urinal. However, the mat shape could readily be adapted and extended in size to fit under or adjacent a row of multiple urinals for example.

While preferred embodiments of the present disclosure have been described, it should be understood that various changes, adaptations and modifications can be made therein without departing from the spirit of the invention as claimed.

What is claimed is:

1. A urinal mat comprising:

a flexible, horizontal top layer, less than or equal to ¼ inch in thickness, comprised of a porous grid or open-work, having holes in the range of ⅛ inch in diameter to 2 inches in diameter, within a solid perimeter border, and having a flat top surface;

a flat, compressible, horizontal, disposable, replaceable pad comprised of liquid-absorbent synthetic material, in the range of 1/32 inch in thickness to ⅛ inch in thickness, underlying said top layer and sized to be smaller than said top layer;

a flat, horizontal, solid bottom section, having a horizontal bottom and tapered peripheral sides less than or equal to ½ inch in thickness or height extending from the bottom of said mat to said top layer and ending with a flat horizontal peripheral border around a recessed central body in said bottom section for receiving said top layer and said pad, said recessed central body having a depth equal to the thickness of the top layer and underlying pad;

wherein said top layer and said pad are smaller than said bottom section and said top layer is sized to match said recessed central body of said bottom section such that said top layer fits snugly but removably inside said recessed central body of said bottom section and the top surface of said top layer is even and level with said peripheral border, and the mat has a total thickness or height of no more than ½ inch;

wherein said top layer and said bottom section are comprised of flexible, heavy-duty material, which is waterproof;

wherein said top layer weighs in the range of 1 pound to 3 pounds and said bottom section weighs in the range of 2 pounds to 7 pounds;

wherein said perimeter border of said top layer has at least one first horizontal protrusion on one side of said perimeter border and has at least one second horizontal protrusion on the opposing side of said perimeter border, and wherein said peripheral border of said bottom section has at least one first horizontal recess corresponding to said at least one first horizontal protrusion and has at least one second horizontal recess corresponding to said at least one second horizontal protrusion, such that said at least one first horizontal protrusion interlocks with said at least one first horizontal recess and said at least one second horizontal protrusion interlocks with said at least one second horizontal recess, so as to interlock said top layer to said bottom section for an interlocking fit of said top layer to said bottom section; and wherein said perimeter border has a first wavy, zig-zag or irregular shaped edge and said peripheral border has a second wavy, zig-zag or irregular shaped edge that is corresponding to and complementary with said first wavy, zig-zag or irregular shaped edge, such that said first edge of said perimeter border and said second edge of said peripheral border fit together to reinforce or secure said interlocking fit of said top layer to said bottom section.

2. The mat of claim 1 wherein said at least one first horizontal protrusion and said at least one first horizontal recess each have a mushroom or "T" shape for interlocking said at least on first horizontal protrusion and said at least on first horizontal recess and said at least one second horizontal protrusion and said at least one second horizontal recess each have a mushroom or "T" shape for interlocking said at least one second horizontal protrusion and said at least one second horizontal recess.

3. The mat of claim 1 wherein said pad has substantially the same shape as said top layer, except said pad does not have any perimeter protrusions.

4. The mat of claim 1 wherein said porous grid or open work comprises a pattern of walls with holes and the walls have a hill-type or convex vertical shape to direct fluids through the grid or open work to said underlying pad for absorption.

5. The mat of claim 4 wherein the porous grid or open work consists of holes 1½ inches in diameter.

6. The mat of claim 1 wherein said bottom section and said top layer are manufactured by molding or extrusion.

7. The mat of claim 1 wherein said mat has an overall regular or irregular polygonal shape.

8. The mat of claim 1 wherein said mat has an overall oval or circular shape.

9. The mat of claim 1 wherein the pad has a bottom layer, material or film that is impermeable to liquid.

10. The mat of claim 1 wherein the top layer and the bottom section are comprised of rubber, synthetic rubber, silicone rubber, silicone, or soft plastic.

11. The mat of claim 1 wherein said at least one first horizontal protrusion and said at least one first horizontal recess each include a hook shape.

12. The mat of claim 1 wherein said at least one first horizontal protrusion has a letter-of-the-alphabet shape and said at least one first horizontal recess has a letter-of-the-alphabet shape which is the same letter-of-the-alphabet shape as the letter-of-the-alphabet shape that said at least one first horizontal protrusion has.

13. The mat of claim 1 wherein the mat is sized to fit beneath a wall mounted urinal or adjacent the front of a floor mounted urinal.

14. A urinal mat comprising:

a flexible, horizontal top layer, less than or equal to ¼ inch in thickness, comprised of a porous grid or open-work, having holes in the range of ⅛ inch in diameter to 2 inches in diameter, within a solid perimeter border;

a flat, compressible, horizontal, disposable, replaceable pad comprised of liquid-absorbent synthetic material, in the range of 1/32 inch in thickness to ⅛ inch in thickness, sized to match or be smaller than said top layer;

a flat, horizontal, solid bottom section, having a horizontal bottom and tapered peripheral sides less than or equal to ½ inch in thickness or height extending from the bottom of said mat to said top layer and ending with a flat horizontal peripheral border around a recessed central body in said bottom section less than or equal to ¼ inch in thickness, for receiving said top layer and said pad;

wherein said top layer and said pad are smaller than said bottom section and said top layer is sized to match said recessed central body of said bottom section such that said top layer fits snugly but removably inside said recessed central body of said bottom section and fits evenly within said peripheral border of said bottom section such that said top layer of said mat is level and flat in a horizontal plane when fitted inside said bottom section with said pad underlying said top layer within said recessed central body; and wherein said top layer and said bottom section are comprised of flexible, heavy-duty material, which is waterproof; and wherein said perimeter border of said top layer has at least one first horizontal recess on one side of said perimeter border and has at least one second horizontal recess on the opposing side of said perimeter border, and wherein said peripheral border of said bottom section has at least one first horizontal protrusion corresponding to said at least one first horizontal recess and has at least one second horizontal protrusion corresponding to said at least second horizontal recess, such that said at least one first horizontal recess interlocks with said at least one first horizontal protrusion and said at least one second horizontal recess interlocks with said at least one second horizontal protrusion, so as to interlock said top layer to said bottom section for an interlocking fit of said top layer to said bottom section; and wherein said perimeter border has a first wavy, zig-zag or irregular shaped edge and said peripheral border has a second wavy, zig-zag or irregular shaped edge that is corresponding to and complementary with said first wavy, zig-zag or irregular shaped edge, such that said first edge of said perimeter border and said second edge of said peripheral border fit together to reinforce or secure said interlocking fit of said top layer to said bottom section.

* * * * *